US006194838B1

(12) United States Patent
Beeteson et al.

(10) Patent No.: US 6,194,838 B1
(45) **Date of Patent: *Feb. 27, 2001**

(54) SELF STABILIZING NON-THERMIONIC SOURCE FOR FLAT PANEL CRT DISPLAYS

(75) Inventors: John Stuart Beeteson, Skelmorlie; Andrew Ramsay Knox, Kilbirnie; Christopher Carlo Pietrzak, Gourock, all of (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/025,949

(22) Filed: Feb. 19, 1998

(30) Foreign Application Priority Data

Feb. 24, 1997 (GB) ..... 9703807
Sep. 10, 1997 (GB) ..... 9719109

(51) Int. Cl.[7] ..... G09G 1/04; H01J 29/70
(52) U.S. Cl. ..... 315/169.3; 315/366; 313/495
(58) Field of Search ..... 315/169.3, 366, 315/169.1, 160; 313/495, 496, 497

(56) References Cited

U.S. PATENT DOCUMENTS 3,935,500 * 1/1976 Oess et al. ..... 313/495
5,070,282 12/1991 Epsztein ..... 315/383
5,272,419 12/1993 Park ..... 315/169.1
5,760,548 * 6/1998 Beeteson et al. ..... 316/366
5,939,842 * 8/1999 Beeteson et al. ..... 315/366

FOREIGN PATENT DOCUMENTS 0 213 839 8/1986 (EP) .
0 685 869 5/1995 (EP) .

* cited by examiner

*Primary Examiner*—David Vu
(74) *Attorney, Agent, or Firm*—Louis P. Herzberg

(57) ABSTRACT

A virtual non-thermionic cathode has the position of a space charge cloud associated with it fixed by the geometry of a fixed insulating layer. The layer can be made to accurate dimensions and hence the cathode to control grid dimension can be accurately controlled and will not change as a result of any mechanical, electrical or physical changes in the construction. The fixed insulating layer is located on a surface of the control grid facing the cathode. A space charge layer is built up on the surface of the insulating layer facing the cathode, and thus emission from the cathode is stabilized.

38 Claims, 3 Drawing Sheets

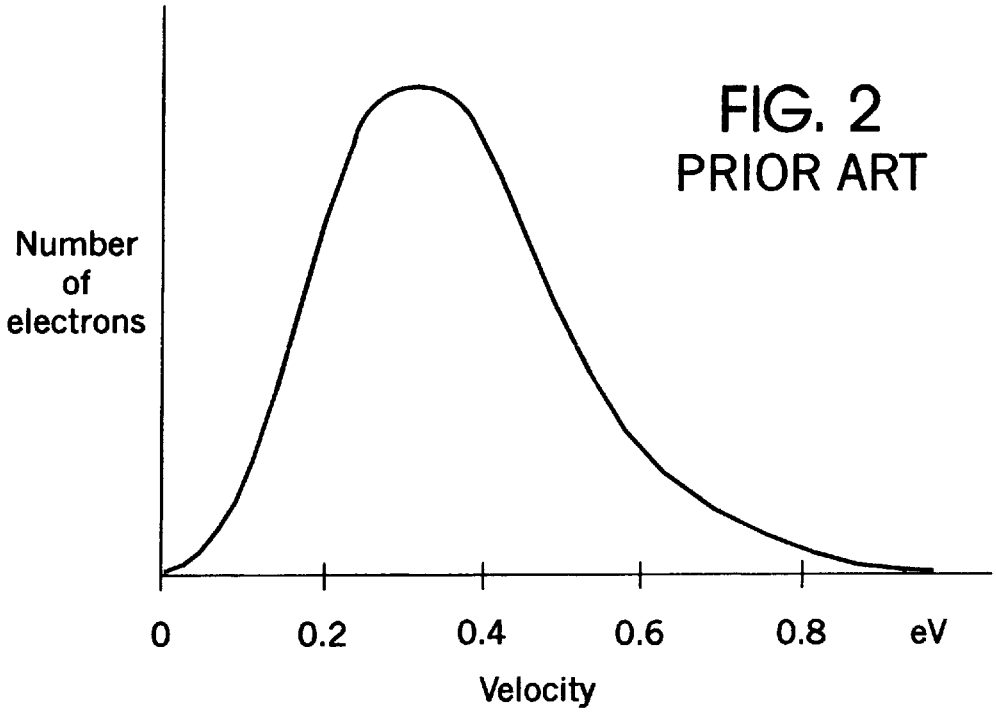
FIG. 2
PRIOR ART
FIG. 3
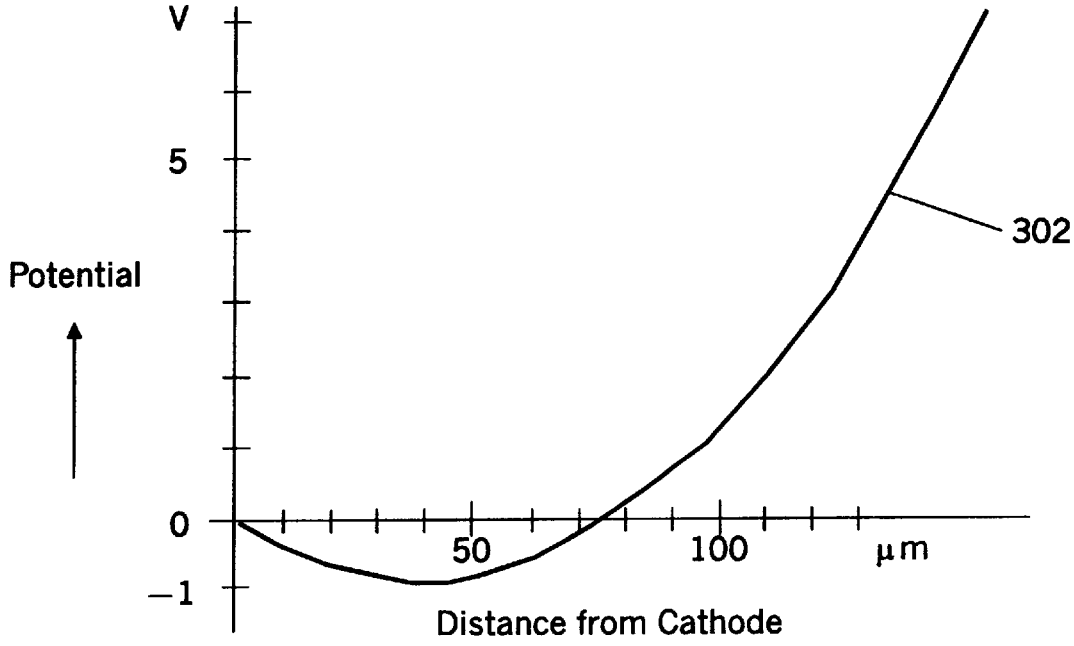

SELF STABILIZING NON-THERMIONIC SOURCE FOR FLAT PANEL CRT DISPLAYS

FIELD OF THE INVENTION

The present invention relates to matrix addressed electron beam displays and particularly to a self stabilizing non-thermionic cathode for use in matrix addressed electron beam displays.

BACKGROUND OF THE INVENTION

Flat panel electron beam displays comprise a cathode and an anode contained in an evacuated envelope. In operation, the cathode is held at a negative potential relative to the anode. Electrons are emitted from the cathode. The potential difference between the cathode and the anode accelerates the emitted electrons from the cathode towards the anode. This is formed, within the display, into a beam. A beam current thus flows between the anode and the cathode. In flat panel electron beam displays a matrix arrangement is disposed between the cathode and the anode. The matrix arrangement is formed by a pair of "combs" placed at right angles to each other. These are commonly referred to as rows and columns. Each pixel or subpixel lies at the intersection of a row and a column. Each of the combs has many separate elements (rows or columns). In operation, a control voltage is applied to each element of each of the combs. The control voltage applied to each element imposes an electrostatic force on the electron beam associated with that element. The electron beam current associated with that element can be adjusted by adjusting the control voltage.

Matrix driven flat CRT displays require the use of an area cathode to provide a uniform source of electrons to each pixel aperture. Thermionic cathodes can be used, but these require heating to obtain emission, with its consequent problems of power dissipation and thermal management for the other parts of the flat CRT display. Field emission electron sources such as MIMs, PFEs and FEDs do not require heating, but are non space charge limited and suffer from problems of uniformity and instability that require some form of smoothing to make their use practical.

SUMMARY OF THE INVENTION

In accordance with the present invention, there is now provided an electron source comprising non-thermionic cathode means and control grid means wherein the control grid means controls a flow of electrons from the cathode means and the electrons are formed into one or more electron beams for guidance towards a target, the control grid means having an insulating layer located on a side facing the cathode means, the surface of the insulating layer facing the cathode being at a predetermined distance from the control grid and being perforated with one or more apertures for each of the one or more electron beams.

The technique can be used to make a non-thermionic cathode into a self limiting space charge electron source, with the advantages of the inbuilt smoothing and averaging that space charge operation implies.

An isolated, conducting layer is preferably formed on the surface of the flat insulated layer facing the cathode. In a preferred embodiment, the conducting layer may be connected to a controlled leakage resistance. A voltage measuring device may be connected to the conducting layer. The conducting layer helps to prevent local charge changes and ensure that the insulating layer has a uniform potential. The controlled leakage resistance allows the insulating layer voltage to respond to reductions as well as increases in electron accumulation.

Preferably, the cathode means comprises a Metal Insulator Metal or a printed film emitter device.

In a further embodiment, the cathode is divided into stripes, each stripe corresponding to a drive line of a display, and the stripes are turned on, only when required. This means that the cathode can be pulsed on only when required and can run at a low duty cycle of perhaps 0.1%. This will allow the emitter life to be extended.

Preferably, the insulating layer extends down to the cathode in spaces between the drive lines of a display.

Further preferably, the electron source further comprising an isolated, conducting layer formed on the internal surfaces of the channels formed by the insulating layer. The conducting layer helps to prevent local charge changes and ensure that the insulating layer has a uniform potential. A controlled leakage resistance may be connected to this layer to allow the insulating layer voltage to respond to reductions as well as increases in electron accumulation. The isolated, conducting layer may be formed on the internal surface, facing the cathode, of the channels formed by the insulating layer.

Preferably, the stripes in the cathode are turned on one line before they are required. This provides time for the electron cloud to build up before beam current is extracted.

The invention also provides a display device comprising: an electron source as described above; a screen for receiving electrons from the electron source, the screen having a phosphor coating facing the side of the collimation block remote from the cathode; and means for supplying control signals to the control grid means and anode means to selectively control flow of electrons from the cathode to the phosphor coating via the channels thereby to produce an image on the screen.

Also provided by the invention is a computer system comprising: memory means; data transfer means for transferring data to and from the memory means; processor means for processing data stored in the memory means; and a display device as described above for displaying data processed by the processor means.

BRIEF DESCRIPTION OF THE DRAWINGS

Preferred embodiments of the present invention will now be described, by way of example only, with reference to the accompanying drawings in which:

FIG. 2 is a graph of the velocity distribution of electrons emitted from the cathode of FIG. 1;

FIG. 3 is a graph of the potential versus distance from the cathode of a typical structure, such as that of FIG. 1;

DETAILED DESCRIPTION OF THE INVENTION

Figure 1:
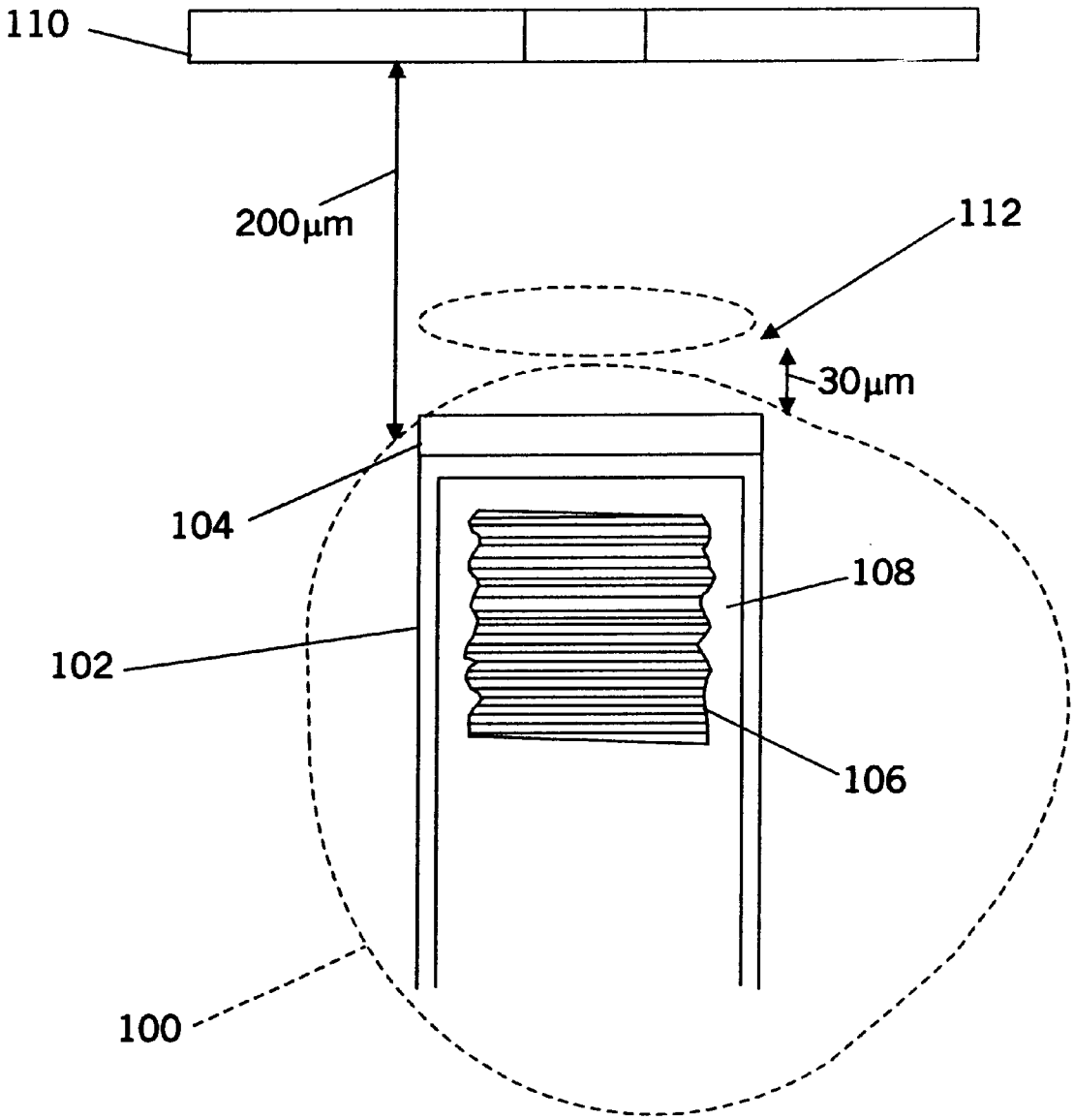
FIG. 1 PRIOR ART
FIG. 1 is a diagram of a typical prior art indirectly heated thermionic cathode of the type used in CRTs.

FIG. 1 shows a prior art typical indirectly heated thermionic cathode 100 of the type used in conventional CRTs. A metal sleeve 102, typically Nickel, is held at zero volts and indirectly heated by a heater 106 so that the 100 μm thick oxide coating 104 reaches about 750° C. An electrical insulator 108 is present between the heater 106 and the metal sleeve 102. The oxide coating 104 typically consists of a mixture of the oxides of Barium, Strontium and Calcium, and at temperatures high enough for the thermal energy of the electrons to exceed the surface work function (typically 1.5 eV) emits copious quantities of electrons. The cathode assembly is typically positioned 200 μm from a control electrode or Grid 1 (110). The electrons form a space charge electron cloud 112 positioned about 30 μm from the oxide 104 of the metal sleeve 102. Further details of a cathode of the type shown in FIG. 1 can be found in D A Wright, "A survey of the present knowledge of thermionic emitters", Proc IRE, 1952, pp.125–142.

FIG. 2 shows a graph of the velocity distribution of electrons emitted from the prior art thermionic cathode of FIG. 1. The electrons are emitted with a Maxwellian velocity distribution. In this thermionic cathode, 90% of electrons are emitted with velocities below 0.5 ev.

Space Charge

Of great importance in the operation of the thermionic cathode of FIG. 1 is the space charge effect due to the intrinsic charge of the emitted electrons. At the normal operating temperature of the thermionic cathode, the number of electrons produced is so large that the local potential is significantly depressed, and hence the effective field at the cathode is reduced. Thermionic cathodes are normally operated in a space charge limited mode, in which the emission temperature is sufficient to produce a potential minimum a short distance from the cathode, hence masking local emission variations from the physical cathode surface. Electrons are drawn from a "virtual cathode", which is located at this potential minimum.

FIG. 3 illustrates the effect with a curve from a diode simulation. Line 302 shows the local potential at varying distance from the outer surface of the oxide coating 104 of the thermionic cathode 100. The space charge produces a retarding field at the cathode, and only those electrons emitted with sufficient energy to allow them to overcome the potential minimum can now reach the anode. Further discussion of the effects of space charge can be found in K R Spangenberg, "Vacuum Tubes", McGraw-Hill, 1948, pp.168–200. A further increase in cathode temperature above that needed to produce a potential minimum a short distance from the cathode increases the space charge density and further depresses the potential until it is just sufficient to limit the current to its previous value. Thus the electron current flowing is no longer a function of the emission capability of the cathode, but becomes dependant on the anode voltage and the geometry only. The device is said to be operating in a "space charge" limited condition. The effect is such that electrons appear to be produced at low velocity from a point in space just in front of the thermionic cathode; this is referred to as the "virtual cathode".

In FIG. 1, the space charge cloud 112 at the potential minimum—the virtual cathode—is shown, with dimensions typical of a colour CRT. It should be appreciated that the electrons emitted from the virtual cathode 112 will have thermal velocities taken from only a portion of the spread of thermal velocities of electrons emitted from the cathode surface; in fact only the highest velocity electrons will be extracted, and these will have had their velocity reduced to close to zero. This is because the beam current extracted from the virtual cathode is deliberately chosen to be only a small fraction of the total emission electrons. Those electrons not taken away from the virtual cathode in beam current drop back to the cathode, to be replaced in an endless cycle by further thermal electrons. In a typical CRT, only perhaps 2% of the electrons are extracted as beam current at the start of life of the CRT. As a cathode ages, its ability to emit electrons diminishes, and so the effective emission constant drops. This has the effect of reducing the magnitude of the potential minimum (because the electron and hence the space charge density drops) and hence if the beam current is kept constant then the percentage extracted rises and so does the thermal velocity spread (measured in eV) of the extracted electrons.

Non-thermionic electron sources, such as field emission electron sources, for example, MIMS, PFEs and FEDs do not require heating, but have no inherent space charge limiting. The eV emission spread can be high (up to 5 or 6 eV in the case of MIMS, for example) and there can be low frequency instability and problems of uniformity, that require some form of smoothing to make their use practical. The provision of space charge limiting for such non-thermionic cathodes solves these problems and mean that the electron current flowing is no longer a function of the emission capability of the cathode, but becomes dependant on the anode voltage and the geometry only.

It is not difficult to get an emission current from such cathodes which is at least an order of magnitude greater than that required for the actual electron gun currents in an MMD. The emission eV may be high enough to launch the electrons towards the target, or an extractor grid can be added as is known in the prior art.

Figure 5:
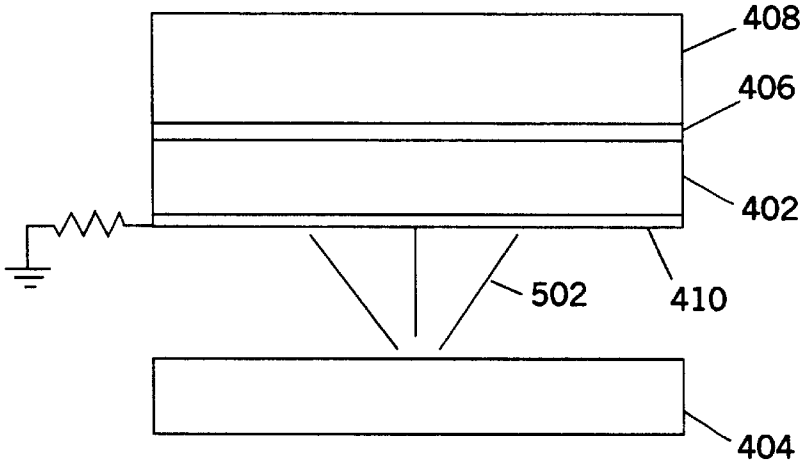
FIG. 5 is a cross-section through the cathode of FIG. 4, shown in an equilibrium state.
Figure 4:
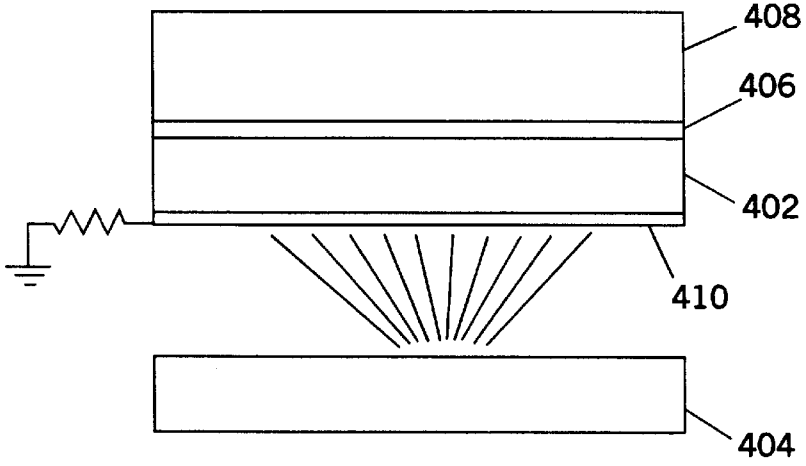
FIG. 4 is a cross-section through a first embodiment of a cathode of the present invention, shown when first powered on and with no picture displayed.

In the present invention, illustrated in FIGS. 4 and 5, an insulating layer 402 is used in conjunction with the field emission electron source 404 and is placed at a fixed distance from the control grids 406. Preferably this is simply a ceramic plate attached directly on the underside of a magnet used for the collimation block 408. The insulating layer 402 is perforated with an aperture per pixel. The collimation block is typically 1 to 5 mm thick, the grids are of the order of a few μm and the insulator is typically less than 50 μm thick. Since the cathode 404 plane is typically 100–200 μm from the control grids 406, it is easy to make this to very high accuracy, particularly over short lateral distances, as is the requirement in a display. The collimation block collimates the electrons to form them into a beam which is directed at a phosphor screen.

Referring to FIG. 4, when power is first applied to the display (at start up), it is necessary that the layer 402 be in a field sufficiently positive to ensure that all electrons strike the insulating layer 402, that is the field at the layer must be more positive than at the cathode 404. Since the field at the cathode is negative, then a voltage of zero volts at the insulating layer is suitable. Control elements later in the display, such as a first anode, can be used to ensure that there is no picture on the screen during the few seconds necessary for heater warm up and cathode stabilisation as is well known in the art of CRT design and manufacture. FIG. 4 shows the conditions when power is first applied to the cathode. Electrons are emitted from the cathode 404.

As time goes on, electrons will be attracted to the insulating layer 402 and gradually build up a surface charge. The charge density created on the surface of the insulating layer 402 will give rise to a surface potential, and this must reach an equilibrium condition in which a negative value of surface potential is achieved that eventually just turns back all electrons towards the cathode. This is now an equilibrium for static conditions and is shown in FIG. 5. The path of a typical electron is shown in FIG. 5 identified by the reference numeral 502. After the operating conditions have stabilized, the control grids must be taken to their normal operating voltages.

We now have a self stabilized cathode operating with electron paths which are the same as in the conventional arrangement, with the stabilization being achieved by means of the use of a space charge limited cathode.

Dynamic Conditions

The simple scheme outlined above has some problems when dynamic conditions are considered.

First, when control grids are switched from zero volts after start up to their normal operating negative voltage of about −3 V, the capacitive pulse this generates will be transferred to the charged side of the insulating layer and hence the virtual cathode electrons will move away from the layer.

Second, when voltages on the control grids 406 are switched during operation, the capacitance between the grids (primarily grid 1) and the electron charge on the base of the insulating layer 402 may cause the attraction of further electrons if there is any imbalance between one grid switching positive and the next switching negative. This will change the local voltage set up on the insulating layer 402. Also, if charge leakage from the insulating layer 402 is low (as would be expected), then any dynamic change in the cathode 404 (e.g. a change in the position of the extractor grid) requiring that there be less charge on the insulating layer 402 would not be acted on immediately. Further, there is the possibility that local charge accumulation on the insulating layer 402 will not be uniform, resulting in a non uniform cathode 404 to insulating layer 402 distance.

In a preferred embodiment, these effects can be corrected by various critical changes described below.

The underside of the insulating layer 402 can be coated with a conducting surface, such as by deposition of a thin metal layer (by sputtering, evaporation or electroless plating) so that local charge changes are prevented, and the surface of the insulating layer will always have a uniform potential.

The conducting layer 410 can be connected via a high resistance path to ground, so that charge can leak away in a controlled manner and allow the insulating layer 402 voltage to respond to reductions as well as increases in electron accumulation. Note that this resistance path would be a high value (in the order of hundreds of MegOhms), so that charge accumulation is still effective. The dynamic changes such as extractor grid position movements due to thermal warm up are long time constants so that a high leakage resistance is appropriate. There will be a constant current taken from the electron source with this resistance in place, but it will be very small.

Start up of the electron source can be simplified by the presence of a conducting layer 410 on the surface of the insulating layer 402 facing away from the control grids 406. The conducting layer 410 is connected, via a high resistance connection, or via an initial charging circuit, to a voltage more positive than the local virtual cathode. Zero volts is suitable, as the local virtual cathode is at a negative voltage, but a fixed positive voltage is advantageous and the high resistance connection could be taken to this point. The extractor grid voltage, if an extractor grid is used, is a suitable fixed positive voltage. As electrons hit the conducting layer, charge accumulation will cause a uniform potential to build up as previously described until a stable condition is achieved with all electrons turning back just before striking the conducting layer, and with a conducting layer voltage approximately the same value as the local virtual cathode. The control electrodes can remain at their normal operating levels with this configuration.

A step by step description of the start up and operation of an electron source with a conducting layer on the insulating layer connected via a high resistance will now be given.

Startup

Step 1—The cathode 404 is at zero volts and has no emission. The control grids 406 all have no potential applied.

Step 2—The cathode 404 has power applied. The extraction grid, if used, is taken to about +10 volts in order for it to operate. The conducting layer 410 is taken positive by either an initializig circuit or allowed to rise positive by an RC time constant.

Step 3—The conducting layer 410 stabilzes at a positive voltage.

Step 4—The cathode 404 starts emission. Initially, the cathode 404 will be in a saturation mode and all electrons are accelerated towards the extractor grid. Most electrons continue past the extractor grid and begin decelerating (at a rate dependent on the positive voltage set on the conducting layer 410). Electrons strike the conducting layer 410, and the layer potential begins to fall. Some current will flow through the high resistance connection, but not sufficient to remove all the electrons from the layer.

Step 5—The cathode 404 reaches operating levels of emission and becomes space charge limited. The conducting layer 410 potential continues to fall until it becomes approximately the same as the local virtual cathode (typically −0.2 V). Because there is a small current flowing through the high resistance connection, some electrons continue to strike the layer, and hence the layer voltage will be a few mV more positive than the virtual cathode.

Operation

Step 6—Electrons which have a potential of nearly 0 eV are accelerated away from the virtual cathode space charge cloud by the extractor grid. Electrons which miss the extractor grid wires (around 95% of the electrons) slow down as they approach the conducting layer 410 on the insulated layer 402, reach a potential of 0 eV just at the layer surface, stop and then reverse direction back towards the extractor grid. Electrons which miss the extractor grid wires (around 95% of the electrons) continue until they are slowed, stopped and reversed near the cathode filament wires. This cycle continuously repeats, although the number of cycles is limited by the transmission of the extractor grid.

We have thus achieved a self stabilized space charge limited cloud formed under the insulating layer as before. A major advantage of such a scheme is that high eV electrons will be at the front of the cloud, and so when beam current is extracted we get a low eV spread in the electron gun (provided we extract only a proportion of the available electrons). In addition we have the averaging and smoothing effect of a uniform potential electron cloud, and a reservoir of electrons to smooth out any low frequency instabilities in local emitter sites.

The voltage on the layer due to the emitted ev can be easily compensated by making the top layer of the emitter at an equivalent negative voltage (these sorts of emitters tend to be a sandwich arrangement where the lower layer will be held at a negative voltage to create an extraction voltage gradient). The layer voltage can be used in a control system to keep the layer voltage steady near zero.

Striped Cathode

Figure 6:
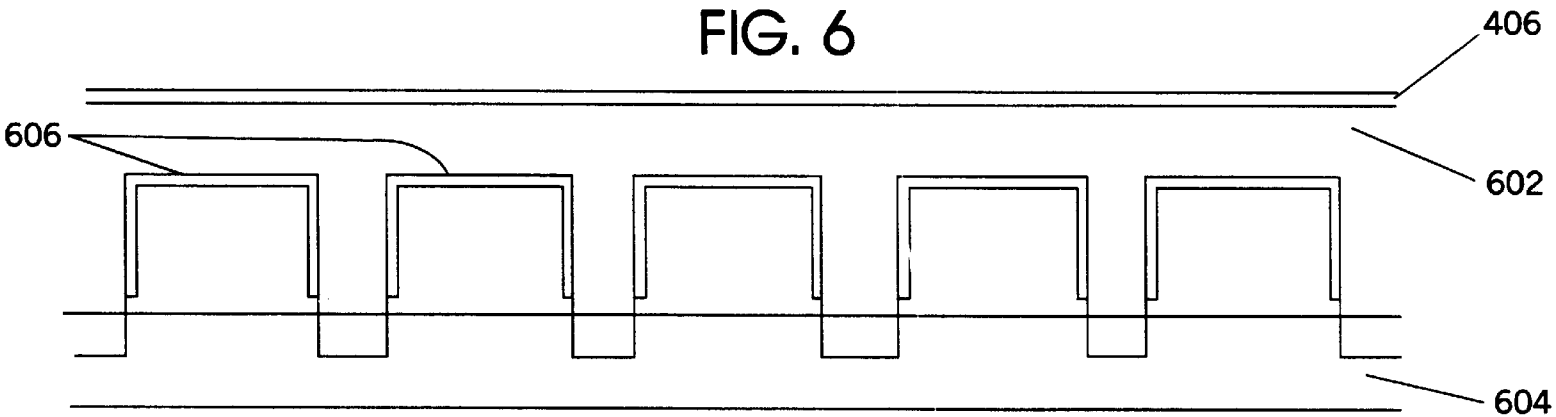
FIG. 6 is a cross-section through a second embodiment of the present invention, in which the cathode is striped.

One of the realities of present generation emitters based on field emission is that emission drops off rapidly unless the cathode is pulsed on only when required (i.e. the cathode will be run at a low duty cycle: 1/1024 in the case of an XGA type of display). FIG. 6 shows a self stabilizing layer concept which can be used in this situation. The cathode 604 is striped to match the drive lines of the display. An insulating layer 602 is placed over the cathodes 604 as in the emitter of FIGS. 4 and 5, but the insulating layer 602 extends down to the cathode 604 in the spaces between the drive lines. The channel internal surfaces are metallized 606 and taken via a leakage path to ground, but the channel and metallizations are kept separate. Since the cathode stripes are close to the layer surface there is no need for a separate extraction grid to be used in this embodiment.

A cathode stripe is switched on when needed and a space charge limited cloud built up on the channel surface as before. If time is needed for the electron cloud to build up then a stripe can be turned on one line in advance.

Individual channel layer voltages may be measured and fed back into the stripe drive circuits to control layer voltage. The individual voltages could be measured via a multiplexer to reduce circuit costs as the switching speeds are low.

In a variation of the emitter of FIG. 6, the metallization is present only on the top portion of the channel. This prevents the enclosed conductor shape approximating to a condition where charge is driven only to the outside surface of the metallization.

The subject matter contained in the certified copies filed with this application, and listed in the declaration, for UK application Nos. 9703807.9 and 9719109.2, filed in the United Kingdom on Feb. 2 , 1997 and Sep. 10, 1997, respectively, is hereby incorporated by reference.

What is claimed is:

1. An electron source comprising non-thermionic cathode means; control grid means wherein the control grid means controls a flow of electrons from the cathode means and the electrons are formed into one or more electron beams for guidance towards a target, the control grid means having an insulating layer located on a side facing the cathode means, the surface of the insulating layer facing the cathode means being at a predetermined distance from the control grid means and being perforated with one or more apertures for each of the one or more electron beams; an isolated conducting layer formed on the surface of the insulating layer; and a controlled leakage resistance connected to the conducting layer.

2. An electron source as claimed in claim 1, wherein the apertures are disposed in the insulating layer in a two dimensional array of rows and columns.

3. An electron source as claimed in claim 1 wherein the controlled leakage resistance has a value of greater than 100 Megohm.

4. An electron source as claimed in claim 1 further comprising a voltage measuring device connected to the conducting layer.

5. An electron source as claimed in claim 1 wherein the non-thermionic cathode means is a Metal Insulator Metal device.

6. An electron source as claimed in claim 1 wherein the non-thermionic cathode means is a printed film emitter device.

7. An electron source as claimed in claim 1 wherein the insulating layer is ceramic.

8. An electron source as claimed in claim 1 wherein the insulating layer is less than 50 $\mu$m in thickness.

9. An electron source as claimed in claim 8 wherein the spacing between the cathode means and the control grid means is between 100 $\mu$m and 200$\mu$m.

10. An electron source as claimed in claim 1 wherein the cathode means is divided into stripes, each stripe corresponding to a drive line of a display, and the stripes are turned on, only when required.

11. An electron source as claimed in claim 10 wherein the insulating layer extends down to the cathode means in spaces between the drive lines of the display.

12. An electron source as claimed in claim 11 wherein said isolated conducting layer is formed on the internal surfaces of the channels formed by the insulating layer.

13. An electron source as claimed in claim 11 wherein said isolated conducting layer is formed on the internal surface, facing the cathode means, of the channels formed by the insulating layer.

14. An electron source as claimed in claim 10 wherein the stripes in the cathode means are turned on one line before they are required.

15. A display device comprising: an electron source as claimed in claim 10; a screen for receiving electrons from the electron source, the screen having a phosphor coating facing the side of the collimation bock remote from the cathode means; and means for supplying control signals to the control grid means and anode means to selectively control flow of electrons from the cathode means to the phosphor coating via channels thereby to produce an image on the screen.

16. A display device comprising: an electron source as claimed in claim 1; a screen for receiving electrons from the electron source, the screen having a phosphor coating facing the side of the collimation block remote from the cathode means; and means for supplying control signals to the control grid means and anode means to selectively control flow of electrons from the cathode means to the phosphor coating via channels thereby to produce an image on the screen.

17. A computer system comprising: memory means; data transfer means for transferring data to and from the memory means; processor means for processing data stored in the memory means; and a display device as claimed in claim 16 for displaying data processed by the processor means.

18. An electron source comprising a non-thermionic cathode; and a control grid, wherein the control grid controls a flow of electrons from the cathode and the electrons are formed into one or more electron beams for guidance towards a target, the control grid having an insulating layer located on a side facing the cathode, the surface of the insulating layer facing the cathode being at a predetermined distance from the control grid and being perforated with one or more apertures for each of the one or more electron beams, an isolated conducting layer formed on the surface of the insulating layer, and a controlled leakage resistance connected to the conducting layer.

19. An electron source as claimed in claim 18, wherein the apertures are disposed in the insulating layer in a two dimensional array of rows and columns.

20. An electron source as claimed in claim 18, wherein the controlled leakage resistance has a value of greater than 100 MegOhm.

21. An electron source as claimed in claim 20, further comprising a voltage measuring device connected to the conducting layer.

22. An electron source as claimed in claim 18, wherein the non-thermionic cathode is a Metal Insulator Metal device.

23. An electron source as claimed in claim 18, wherein the non-thermionic cathode is a printed film emitter device.

24. An electron source as claimed in claim 18, wherein the insulating layer is ceramic.

25. An electron source as claimed in claim 18, wherein the insulating layer is less than 50 $\mu$m in thickness.

26. An electron source as claimed in claim 18, wherein the spacing between the cathode and the control grids is between 100 $\mu$m and 200 $\mu$m.

27. An electron source as claimed in claim 18, wherein the cathode is divided into stripes, each stripe corresponding to a drive line of a display, and the stripes are turned on, only when required.

28. An electron source as claimed in claim 27, wherein the insulating layer extends down to the cathode in spaces between the drive lines of a display.

29. An electron source as claimed in claim 28, wherein said isolated conducting layer is formed on the internal surfaces of the channels formed by the insulating layer.

30. An electron source as claimed in claim 28, wherein said isolated conducting layer is formed on the internal surface facing the cathode of the channels formed by the insulating layer.

31. An electron source as claimed in claim 27, wherein the stripes in the cathode are turned on one line before they are required.

32. A computer system comprising: a memory; a data transfer circuit for transferring data to and from the memory; a processor for processing data stored in the memory; and a display device as claimed in claim 31 for displaying data processed by the processor.

33. A display device comprising: an electron source as claimed in claim 27; a screen for receiving electrons from the electron source, the screen having a phosphor coating facing the side of the collimation block remote from the cathode; and a signal supplier to supply control signals to the control grid and anode to enable selective control flow of electrons from the cathode to the phosphor coating via the channels, to produce an image on the screen.

34. A display device comprising: an electron source as claimed in claim 18; a screen for receiving electrons from the electron source, the screen having a phosphor coating facing the side of the collimation block remote from the cathode; and a signal supplier to supply control signals to the control grid and anode to enable selective control flow of electrons from the cathode to the phosphor coating via the channels, thereby to produce an image on the screen.

35. An electron source comprising non-thermionic cathode means and control grid means wherein the control grid means controls a flow of electrons from the cathode means and the electrons are formed into one or more electron beams for guidance towards a target, the control grid means having an insulating layer located on a side facing the cathode means, the surface of the insulating layer facing the cathode means being at a predetermined distance from the control grid means and being perforated with one or more apertures for each of the one or more electron beams wherein the cathode means includes an extractor grid means and the electron source further comprises a controlled leakage resistance connected to the extractor grid means.

36. An electron source as claimed in claim 35 wherein the controlled leakage resistance has a value of greater than 100 MegOhm.

37. An electron source comprising a non-thermionic cathode; and a control grid, wherein the control grid controls a flow of electrons from the cathode and the electrons are formed into one or more electron beams for guidance towards a target, the control grid having an insulating layer located on a side facing the cathode, the surface of the insulating layer facing the cathode being at a predetermined distance from the control grid and being perforated with one or more apertures for each of the one or more electron beams; an isolated conducting layer formed on the surface of the insulating layer facing the cathode; and wherein the cathode includes an extractor grid, and the electron source further comprises a controlled leakage resistance connected to the extractor grid.

38. An electron source as claimed in claim 37, wherein the controlled leakage resistance has a value of greater than 100 MegOhm.

* * * * *